US011578678B2

(12) United States Patent
Baranowski et al.

(10) Patent No.: US 11,578,678 B2
(45) Date of Patent: Feb. 14, 2023

(54) METHOD FOR PRODUCING A CAST ALUMINUM COMPONENT, AND CYLINDER HEAD FOR A MOTOR VEHICLE, AND PRODUCTION LINE FOR CARRYING OUT A METHOD

(71) Applicant: Ford Global Technologies, LLC, Dearborn, MI (US)

(72) Inventors: Thomas Baranowski, Würselen (DE); Maik Broda, Würselen (DE); Pascal Rebmann, Weilerswist (DE); Markus Franzen, Stolberg (DE)

(73) Assignee: Ford Global Technologies, LLC, Dearborn, MI (US)

( * ) Notice: Subject to any disclaimer, the term of this patent is extended or adjusted under 35 U.S.C. 154(b) by 259 days.

(21) Appl. No.: 17/132,444

(22) Filed: Dec. 23, 2020

(65) Prior Publication Data

US 2021/0215117 A1 Jul. 15, 2021

(30) Foreign Application Priority Data

Jan. 10, 2020 (DE) ..... 102020200262.2

(51) Int. Cl.

| | |
|---|---|
| ***F02F 1/42*** | (2006.01) |
| ***F02F 1/24*** | (2006.01) |
| ***B22D 19/00*** | (2006.01) |

(52) U.S. Cl.

CPC ..... *F02F 1/24* (2013.01); *B22D 19/0009* (2013.01); *F02F 2200/06* (2013.01)

(58) Field of Classification Search

CPC ..... B22D 15/00; B22D 29/00; B22D 19/00; B22C 1/14; B33Y 80/00

USPC ..... 123/193.5

See application file for complete search history.

(56) References Cited

U.S. PATENT DOCUMENTS

| | | | | |
|---|---|---|---|---|
| 6,921,503 | B1 | 7/2005 | Sherwood | |
| 2006/0254744 | A1 | 11/2006 | Gordon et al. | |
| 2017/0074205 | A1* | 3/2017 | Maki | B22D 19/0009 |
| 2017/0297086 | A1 | 10/2017 | Debruin | |
| 2018/0114740 | A1* | 4/2018 | Liu | H02M 7/003 |

* cited by examiner

*Primary Examiner* — Long T Tran
*Assistant Examiner* — James J Kim
(74) *Attorney, Agent, or Firm* — Burris Law, PLLC

(57) ABSTRACT

A method for producing a cast aluminum component having at least one reinforcing element arranged therein includes producing a core by placing at least one reinforcing element in a first mold and at least partially overmolding the at least one reinforcing element with a foam material. In the alternative, or in addition to, a core is produced by surrounding an inner element composed of a foam material by at least one reinforcing element. The method includes placing the core in a second mold and pouring liquid aluminum into the second mold and overcasting the core such that the liquid aluminum at least partially surrounds the core and the foam material is at least partially removed during the overcasting.

20 Claims, 2 Drawing Sheets

METHOD FOR PRODUCING A CAST ALUMINUM COMPONENT, AND CYLINDER HEAD FOR A MOTOR VEHICLE, AND PRODUCTION LINE FOR CARRYING OUT A METHOD

CROSS-REFERENCE TO RELATED APPLICATIONS

This application claims priority to and the benefit of German Patent Application Number 102020200262.2, filed on Jan. 10, 2020. The disclosure of the above application is incorporated herein by reference.

FIELD

The present disclosure relates to a method for producing a cast aluminum component having at least one reinforcing element arranged therein.

BACKGROUND

The statements in this section merely provide background information related to the present disclosure and may not constitute prior art.

U.S. Pub. No. 2017/0297086 A1 discloses a method for producing a cast component, wherein a structure composed of polylactic acid is first of all produced by 3-D printing and is then provided on its outside with sand. In a subsequent step, the structure is placed in a container, and metal is poured into the structure. During this process, the structure composed of polylactic acid melts, and the resulting metal component acquires the shape of the original structure.

U.S. Pub. No. 2006/0254744 A1 discloses a method for selectively reinforcing a structure, wherein at least two tapes composed of a metal matrix composite material are arranged in a mold, and wherein the mold is filled with a material, with the result that the two tapes are arranged within the material. The tapes can be tapes composed of aluminum oxide in an aluminum matrix, and the material can be metal, polymer, foam, glass or ceramics.

U.S. Pat. No. 6,921,503 B1 discloses a method for producing a fiber-reinforced polymer component. In this case, two spacers are first of all placed in a mold, wherein a cavity is formed between the two spacers. This cavity is filled with a foamable material, which expands between the spacers in the cavity and forms a foam core. The spacers are then removed from the mold, and the foam core is surrounded with fibers, and the mold is closed again. In the next method step, resin is introduced in the region of the spacers and is cured. The foam core within the fibers is then removed.

SUMMARY

This section provides a general summary of the disclosure and is not a comprehensive disclosure of its full scope or all of its features.

The present disclosure provides a method for producing a cast aluminum component, a cylinder head produced by the method, and a production line for carrying out the method. In some variations, the method provides for production of a cast aluminum component having a reinforcing element.

In one form of the present disclosure, a method for producing a cast aluminum component having at least one reinforcing element arranged therein comprises producing a core, wherein at least one reinforcing element is placed in a first mold and at least partially overmolded with a foam material, or wherein an inner element composed of a foam material is at least partially surrounded by at least one reinforcing element, or wherein at least one reinforcing element is placed in a first mold and is at least partially overmolded with a foam material to produce a core element, and wherein the core element is then at least partially surrounded by at least one reinforcing element. As used herein, the terms "overmolded" and "overmolding" refer to a process of forming a part by partially or fully covering a first material with a second material. The core is placed in a second mold and liquid aluminum is poured into the second mold, such that the poured liquid aluminum at least partially surrounds the core and the foam material is at least partially removed during this overcasting step or process.

In some variations, for example when the core is overmolded with the foam material, the reinforcing element is completely surrounded by the foam material. In such variations, the first mold has a cavity in which the reinforcing element is placed and the foam material is injected into and expands in the cavity.

In other variations, an inner element is first produced from a foam material, which is then at least partially surrounded by a reinforcing element. In such variations the inner element composed of foam can be produced in the first mold by injection molding.

In still other variations, a core element comprising a first reinforcing element is formed and then the core element is overmolded with foam material. In such variations, the core element can be at least partially surrounded by a further (e.g., second) reinforcing element such that the core has at least two reinforcing elements with one reinforcing element arranged within the core and another reinforcing element arranged on an outer surface of the core.

After the core is formed, the core is transferred to a second mold that has a cavity defining a shape of a cast aluminum component to be cast. Aluminum (i.e., liquid aluminum) is then poured into the second mold such that the core is at least partially surrounded by aluminum. In addition, and due to high temperatures of the aluminum casting process, the foam material is removed at least partially, and in some variations completely. In some variations the foam material vaporizes. However, the at least one reinforcing element remains in the cast aluminum and is at least partially surrounded by the cast aluminum.

After cooling of the cast aluminum, the cast aluminum component provided with the at least one reinforcing element is removed from the second mold and used further.

A method according to the present disclosure provides in a simple manner at least one reinforcing element in a cast component made of aluminum. Combining the reinforcing element with the foam material enables the foam material to be used as a support or holder of the reinforcing element. Also, the foam material provides arrangement of the reinforcing element in the second mold such that the reinforcing element is positioned within the cast component without structural modification of the second mold and without expensive holding structures, holding devices and/or holding equipment.

The foam material, which is removed or volatilizes during the casting process, does not remain in the cast component and/or does not have to be removed with an additional method step.

The method according to the teachings of the present disclosure provides cast aluminum components with reinforcing elements. It should be understood that cast aluminum components with reinforcing elements are particularly light and, at the same time, have a high rigidity, at least in the region of the reinforcing elements. The introduction of reinforcing elements provides for production of desired aluminum cast components without ribs or walls having relatively large material thicknesses, thereby reducing weight of such aluminum cast components.

In one form of the present disclosure, the at least one reinforcing element is a tape. As used herein, the term "tape" refers an elongate flat strip. In some variations, the tape is desired for forming reinforcing regions of a cast aluminum component. For example, the stiffness of thin walls of a cast aluminum component can be reinforced in a suitable manner with the tape without having to change the material thickness of the wall. Also, tape can be wound around a core element or an inner element and/or can be overmolded.

In at least one variation, the reinforcing element comprises a metal matrix material. In some variations the matrix is aluminum, an aluminum alloy, titanium, a titanium alloy, and/or a steel, and reinforcing fibers or particles, such as ceramic particles, are arranged in the matrix. Alternatively or in addition, the at least one reinforcing element comprises glass fibers.

In some variations, foam materials for the core include polystyrene and/or polyurethane and/or polylactic acid. The foam materials have the property of being removed during the casting of the aluminum, i.e. that the melting point and in some variations the boiling point of the foam material is lower than the melting temperature(s) of the cast material. It should be understood that polyurethane has a desired cost (i.e., polyurethane is inexpensive) and is removed quickly and easily during the casting process. In some variations polyurethane foam is used as a foam material. And in such variations, the polyurethane foam can be formed by introducing a reaction mixture of an isocyanate component and a polyol component into the first mold such that polyurethane is foamed by a resulting cross-linking reaction.

In another form of the present disclosure, surrounding of the reinforcing element with the foam material is executed or performed by injection molding such that a simple and inexpensive method for producing a core for the cast aluminum component is provided. In some variations, the core is removed from the first mold after being formed by injection molding, and the first mold is reused to produce additional cores. And in variations where the core is formed by at least partially surrounding an inner element formed from the foam material with at least one reinforcing element, the inner element can be produced by injection molding.

In some variations, a core is produced by winding a reinforcing element around an inner element formed from foam material. For example, reinforcing elements that are in the form of tapes are wound around an inner element formed from foam material. In the alternative, or in addition to, the reinforcing element is laid on the inner element formed from foam material. And in such variations reinforcing elements in the form of tapes re desirable. In at least one variation tape laid on the foam inner element is pressed against the foam inner element. In some variations, a contact pressure roller exerts pressure on the tape(s) that have been applied or laid onto the foam inner element.

In another form of the present disclosure, the casting of the aluminum takes place or is provided under high pressure. As used herein, the phrase "high pressure" refers to pressures in a range of from 10 megapascals (MPa) to 200 MPa. And in some variations, flow rates in a range of from 8 meters per second (m/s) to 16 m/s are achieved, with the result that enhanced temperature distribution is achieved in the mold and enhanced uniform removal of the foam material from the first mold is provided.

In some variations of the present disclosure, a cylinder head for a motor vehicle is produced by a method according to the teachings of the present disclosure. For example, the arrangement of reinforcing elements in a cylinder head is desirable since the cylinder head is produced with reduction in material (i.e., aluminum) and a desired stiffness is provided by the reinforcing elements. In addition, the cylinder head formed with a reduction in material gas a reduced the thermal expansion caused by high temperatures in the region of an internal combustion engine where the cylinder head is located. It should be understood that the reduced thermal expansion corresponds to or results in a reduction in stresses caused by or resulting from the difference between the thermal expansion coefficient of the cylinder block (generally composed of steel with a heat conduction coefficient in the region of about $12*10^{-6}$ $K^{-1}$) and the cylinder head (cast aluminum component with a heat conduction coefficient in the region of about $23*10^{-6}$ $K^{-1}$).

In some variations, the method according to the teachings of the present disclosure is used to form other components, e.g. longitudinal members and/or crossmembers in a vehicle, or roof bows for a vehicle.

In still another form of the present disclosure, a production line comprising a method according to the teachings of the present disclosure is provided. In some variations, the production line includes a first mold for producing a core, for example a first mold for producing the core via injection molding, and a production station where a reinforcing element is wound around the core or an inner element. In then alternative, or in addition to, a production station is included where reinforcing elements in the form of tape(s) are laid on the core. A second mold is included in which the core is placed and into which the liquid aluminum is poured.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1A:
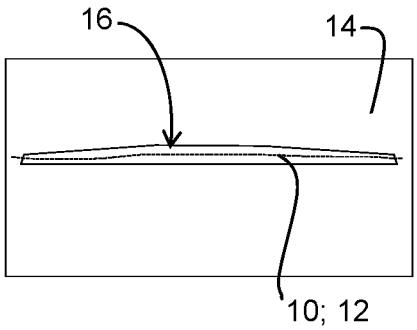
FIG. 1A shows a step of a method according to the present disclosure in accordance with a first form for producing a cast aluminum component.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1B:
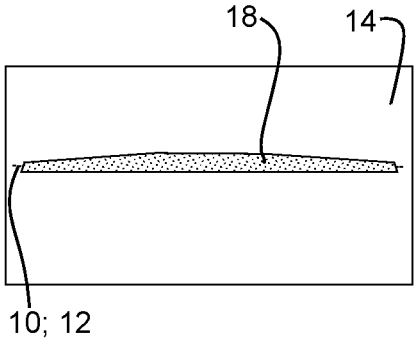
FIG. 1B shows another step of the method according to the present disclosure in accordance with the first form for producing the cast aluminum component.

FIG. 1A shows a first method step, wherein a reinforcing element 10, here in the form of a tape 12 composed of a metal matrix material, is placed in a first mold 14. Formed in the first mold 14 is a cavity 16, which, in a second method step, shown in FIG. 1B, is filled with polyurethane foam (illustrated by dotted areas in the drawings). During this process, the tape 12 is overmolded with the polyurethane foam.

Figure 1C:
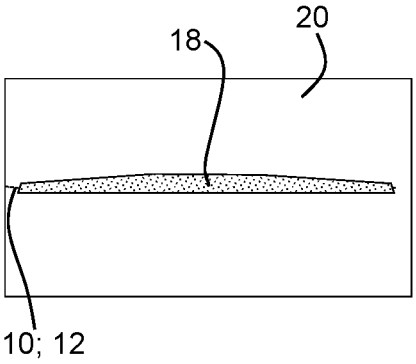
FIG. 1C shows still another step of the method according to the present disclosure in accordance with the first form for producing the cast aluminum component.

After the hardening of the polyurethane foam, the core 18 which is then formed is removed together with the reinforcing element 10 arranged therein from the first mold 14 and, in accordance with method step 3 in FIG. 1C, is placed in a second mold 20.

Figure 1D:
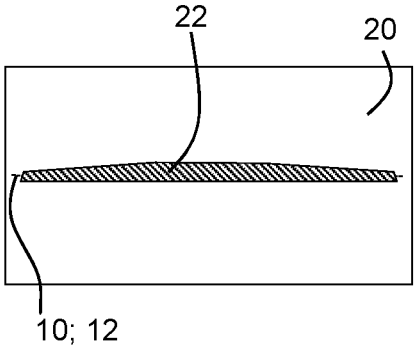
FIG. 1D shows yet another step of the method according to the present disclosure in accordance with the first form for producing the cast aluminum component.

In a fourth method step, shown in FIG. 1D, a cast aluminum component 22 is produced by pouring aluminum (i.e., liquid aluminum) into the second mold 20. During pouring, the polyurethane foam volatilizes, and the volume is filled by the aluminum poured in (here illustrated by a hatched area). After the aluminum has hardened (i.e., solidified), the cast aluminum component 22 that has now formed is removed from the second mold 20. In some variations, the cast aluminum component 22 is a cylinder head 22 of a motor vehicle. In addition, in at least one variation FIGS. 1A to 1D show a production line for carrying out the method described above.

FIGS. 2A to 2D likewise show a method for producing a cast aluminum component 22 with the reinforcing element 10 arranged therein, wherein, in this method, it is the production of the core which differs from the method described in conjunction with FIGS. 1A to 1D.

In describing the second form below, the same reference signs as those used to describe the first form are used for identical or at least functionally identical elements.

Figure 2A:
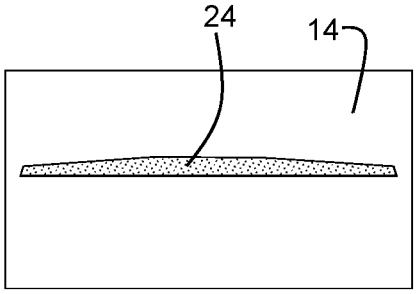
FIG. 2A shows a step of a method according to the present disclosure in accordance with a second form for producing a cast aluminum component.

In a first method step, which is shown schematically in FIG. 2A, an inner element 24 composed of polyurethane foam is first of all produced. For this purpose, a cavity formed in a first mold 14 is filled with polyurethane foam (here illustrated by a dotted area).

Figure 2B:
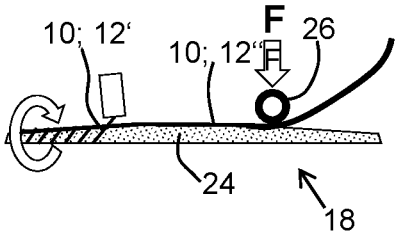
FIG. 2B shows another step of the method according to the present disclosure in accordance with the first form for producing the cast aluminum component.

In a second method step (FIG. 2B), and as shown on the left hand side of the figure, a reinforcing element 10 in the form of a tape 12' composed of a metal matrix material is wound around the inner element 24 composed of polyurethane foam, and as shown on the right hand side of FIG. 2B, a tape 12" composed of a metal matrix material is laid on the inner element 24. In some variations a contact force F is exerted on the tape 12" by a contact pressure roller 26 such that enhanced bonding of the tape 12" to the inner element 24 is provided. It should be understood that in some variations one or more tapes 12' are wound around the inner element 24 and in at least one variation a plurality of tapes 12" are laid on the inner element 24. And in some variations one or more tapes 12' are wound around the inner element 24 and a plurality of tapes 12" are laid on the inner element 24.

Figure 2C:
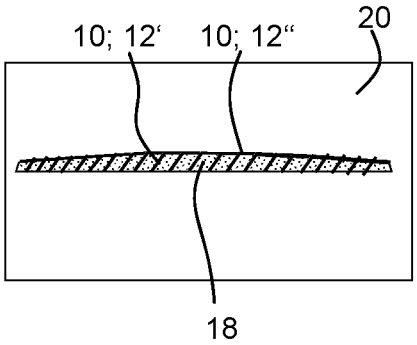
FIG. 2C shows still another step of the method according to the present disclosure in accordance with the first form for producing the cast aluminum component.
Figure 2D:
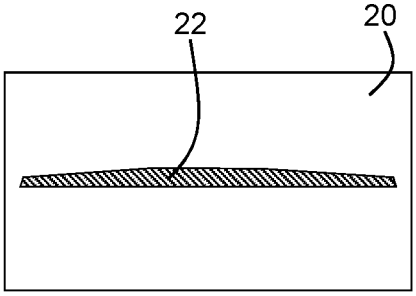
FIG. 2D shows yet another step of the method according to the present disclosure in accordance with the first form for producing the cast aluminum component.

The inner element 24 composed of polyurethane foam, which is surrounded by the tape 12' and/or 12", now forms the core 18 and, in a third method step, which is shown in FIG. 2C, is placed in a second mold 20.

In the fourth method step (FIG. 2D), liquid aluminum (here illustrated in hatched lines) is poured into the second mold 20, the polyurethane foam of the core 18 volatilizes, and the reinforcing elements 10 (not shown in FIG. 2D) remain in the cast aluminum component 22. After cooling, the finished cast aluminum component 22 is removed from the second mold 20. In some variations, the cast aluminum component 22 is a cylinder head 22 of a motor vehicle. In addition, in at least one variation FIGS. 2A to 2D show a production line for carrying out the method described above.

Attention is furthermore drawn to the fact that the production of the cores 18 in accordance with the forms described above can also be combined, such that a core element with a reinforcing element is first of all formed, around which a tape is then wound, and/or a tape is laid on the core element.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method for producing a cast aluminum component having at least one reinforcing element arranged therein, the method comprising:

a) producing a core comprising at least one of placing at least one reinforcing element in a first mold and at least partially overmolding the at least one reinforcing element with a foam material, and surrounding an inner element composed of a foam material by at least one reinforcing element;

b) placing the core in a second mold; and c) pouring liquid aluminum into the second mold and overcasting the core such that the liquid aluminum at least partially surrounds the core and the foam material is at least partially removed during the overcasting.

2. The method according to claim 1, wherein the reinforcing element is a tape.

3. The method according to claim 1, wherein the reinforcing element comprises at least one of a metal matrix material and glass fibers.

4. The method according to claim 1, wherein the foam material comprises at least one of polystyrene and polyurethane.

5. The method according to claim 1, wherein the at least one reinforcing element is overmolded with the foam material via injection molding.

6. The method according to claim 1, wherein the core is produced by placing the at least one reinforcing element in the first mold and at least partially overmolding the at least one reinforcing element with the foam material via injection molding.

7. The method according to claim 1, wherein the core is produced by surrounding the inner element composed of the foam material by the at least one reinforcing element, and the inner element composed of the foam material is formed via injection molding.

8. The method according to claim 1, wherein the at least one reinforcing element is wound around the inner element composed of the foam material.

9. The method according to claim 1, wherein the at least one reinforcing element is laid on the inner element composed of the foam material.

10. The method according to claim 9 further comprising exerting pressure on the at least one reinforcing element laid on the inner element.

11. The method according to claim 10, wherein the pressure is exerted with a contact pressure roller.

12. The method according to claim 1, wherein the at least one reinforcing element is wound around the inner element composed of the foam material and laid on the inner element composed of the foam material.

13. The method according to claim 12 further comprising exerting pressure on the at least one reinforcing element laid on the inner element with a contact pressure roller.

14. The method according to claim 1, wherein the overcasting the core with the liquid aluminum is under high pressure.

15. The method according to claim 1, wherein the liquid aluminum solidifies such that the cast aluminum component is formed.

16. A cylinder head for a motor vehicle formed according to the method of claim 1.

17. A method for producing a cast aluminum component having at least one reinforcing element arranged therein, the method comprising:

a) producing a core comprising by placing at least one reinforcing element in a first mold and at least partially overmolding the at least one reinforcing element with a foam material;

b) placing the core in a second mold; and c) pouring liquid aluminum into the second mold and overcasting the core such that the liquid aluminum at least partially surrounds the core and the foam material is at least partially removed during the overcasting.

18. The method according to claim 17, wherein the foam material comprises at least one of polystyrene and polyurethane and the at least one reinforcing element is overmolded with the foam material via injection molding.

19. A method for producing a cast aluminum component having at least one reinforcing element arranged therein, the method comprising:

a) producing a core by surrounding an inner element composed of a foam material by at least one reinforcing element;

b) placing the core in a second mold; and c) pouring liquid aluminum into the second mold and overcasting the core such that the liquid aluminum at least partially surrounds the core and the foam material is at least partially removed during the overcasting.

20. The method according to claim 19, wherein the inner element composed of the foam material is surrounded by the at least one reinforcing element by at least one of winding the at least one reinforcing element around the inner element, and laying the at least one reinforcing element on the inner element and applying pressure on the at least one reinforcing element that is laid on the inner element.

* * * * *